United States Patent [19]

Beljaars

[11] Patent Number: 4,567,985

[45] Date of Patent: Feb. 4, 1986

[54] NESTABLE AND STACKABLE BOX

[75] Inventor: Johannes M. W. Beljaars, Gilze, Netherlands

[73] Assignee: Curver B.V., Rijen, Netherlands

[21] Appl. No.: 667,222

[22] Filed: Nov. 2, 1984

[30] Foreign Application Priority Data

Nov. 3, 1983 [NL] Netherlands ..... 8303781

[51] Int. Cl.[4] ..... B65D 21/04

[52] U.S. Cl. ..... 206/506

[58] Field of Search ..... 206/506

[56] References Cited

U.S. PATENT DOCUMENTS 4,007,839 2/1977 Stahl .

4,346,805 8/1982 Upperton ..... 206/506

FOREIGN PATENT DOCUMENTS 28060 6/1981 European Pat. Off. .

1387232 12/1964 France .

1383917 2/1975 United Kingdom .

*Primary Examiner*—George E. Lowrance

*Attorney, Agent, or Firm*—Cushman, Darby & Cushman

[57] ABSTRACT

Nestable and stackable box comprising a rectangular bottom, two side walls and a back wall, which walls diverge, starting at the bottom, a lowered front wall and a fold-away stacking support. The front of each side wall has been bevelled off to make an obtuse angle with the top of the side wall, and each side wall has been provided with an opening near its front, the vertical plane bounding the opening at the front being totally before the perpendicular dropped from the vertex of the obtuse angle between the front and the top of the side wall upon the bottom. The part of the wall section between the opening and the front of the side wall goes outward as it goes downward, to a distance of one to three times its horizontal wall thickness, to form a ridge having a width of one to three times the horizontal wall thickness. An inside protrusion has been provided on said ridge and against the outward-going wall section, and on the outside of the side wall and below the opening and outside protrusion, the underside of the outside protrusion being at a distance of at least one third of the side wall height beneath the ridge and extending sidewards not further than the side wall thickness plus the nesting clearance, all this in such a way that in a nesting arrangement the outside protrusion falls behind the inside protrusion.

7 Claims, 6 Drawing Figures

NESTABLE AND STACKABLE BOX

BACKGROUND AND SUMMARY OF THE INVENTION

The invention relates to a nestable and stackable box comprising a rectangular bottom, two side walls and a back wall, which walls diverge, starting at the bottom, a lowered front wall and a foldaway stacking support.

Such a box is known from the French Patent Specification No. 1 387 232. Acces to these boxes is limited when they are in a stacked arrangement, on account of the relatively high front walls. This is disadvantageous when, for example, such boxes are used in shops were the customer is to take objects from the boxes himself. If in these boxes the front wall is lowered to, for example, below the internal stacking ridge, nested boxes are no longer secured in place and may shift relative to one another, which is very disadvantageous in transport.

The aim of the invention is to provide a box which does not have this disadvantage and which does not need a front wall for securing, without causing the loss of an important advantage of the known box, which is that stacked and especially nested boxes form perpendicular assemblies.

This has been achieved by the front of each side wall having been bevelled off to make an obtuse angle with the top of the side wall, by each side wall being provided with an opening near its front. The vertical plane bounding the opening at the front is located totally in advance of the perpendicular projecting from the vertex of the obtuse angle between the front and the top of the side wall upont the bottom, at least part of the wall section between the opening and the front of the side wall expanding outwardly and downwardly, to a distance of one to three times its horizontal wall thickness so as to form a ridge having a width of one to three times the horizontal wall thickness, an inside protrusion is provided on the ridge and against the outward-going wall section while an outside protrusion is provided on the outside of the side wall and below the opening. The underside of the outside protrusion is at a distance of at least one third of the side wall height beneath the ridge while the outside protrusion extends laterally not further than the side wall thickness plus the nesting clearance. The structure of the present invention therefore cooperates such that in a nesting arrangement, the outside protrusion falls behind the inside protrusion to lock the nested boxes.

The boxes according to the invention can be stacked and secured in place with the aid of stacking supports. In a nested arrangement, with the supports folded away, the boxes can be horizontally slid one within the other until the outside protrusion falls behind the inside protrusion. In a nested arrangement, each box is sunk into the next-lower box for about two thirds, while some nesting clearance is maintained to avoid the boxes being stuck one within the other.

Sliding the boxes one within the other can be facilitated by providing the box with outwardly directed rim sections at its top, the height of these rim sections being substantially one third of the side-wall height.

In order also to be able to lower the box more or less vertically into another box during nesting, the plane bounding the opening at the top can be located at substantially one third of the side-wall height from the top of the side wall. The outside protrusions then meet no obstructions on the way down to behind the inside protrusions.

It is advantageous to provide the inside protrusions with top planes going upwards in the direction of the back wall, so that the boxes can be slid one within the other more smoothly.

The box can be provided with means to prevent objects inside the box from sliding out of the box by advantageously providing the box with a lowered front wall designed as a threshold, the inside height of the front wall from the bottom not exceeding the inside distance between the bottom and the ridge.

In a particularly advantageous embodiment of the box, the back wall has been provided near the side walls and near the bottom with backward-projecting stacking protrusions and in that the back wall near the side walls two openings have been provided which extend above the stacking protrusions to near the top of the box, in such a way that in a nesting arrangement the stacking protrusions project through these openings. A box so designed can be stacked with its front resting on a stacking support of a next-lower box and the stacking protrusions being supported by the top of the back wall. Since during nesting first the stacking protrusions can be stuck through the holes in the back wall, the rest of the box can subsequently be lowered more or less vertically until the outside protrusions are in secured position.

BRIEF DESCRIPTION OF THE ACCOMPANYING DRAWINGS

The invention will hereinafter be explained with reference to an embodiment represented in the drawing.

DETAILED DESCRIPTION OF THE PREFERRED EXEMPLARY EMBODIMENTS

Figure 1:
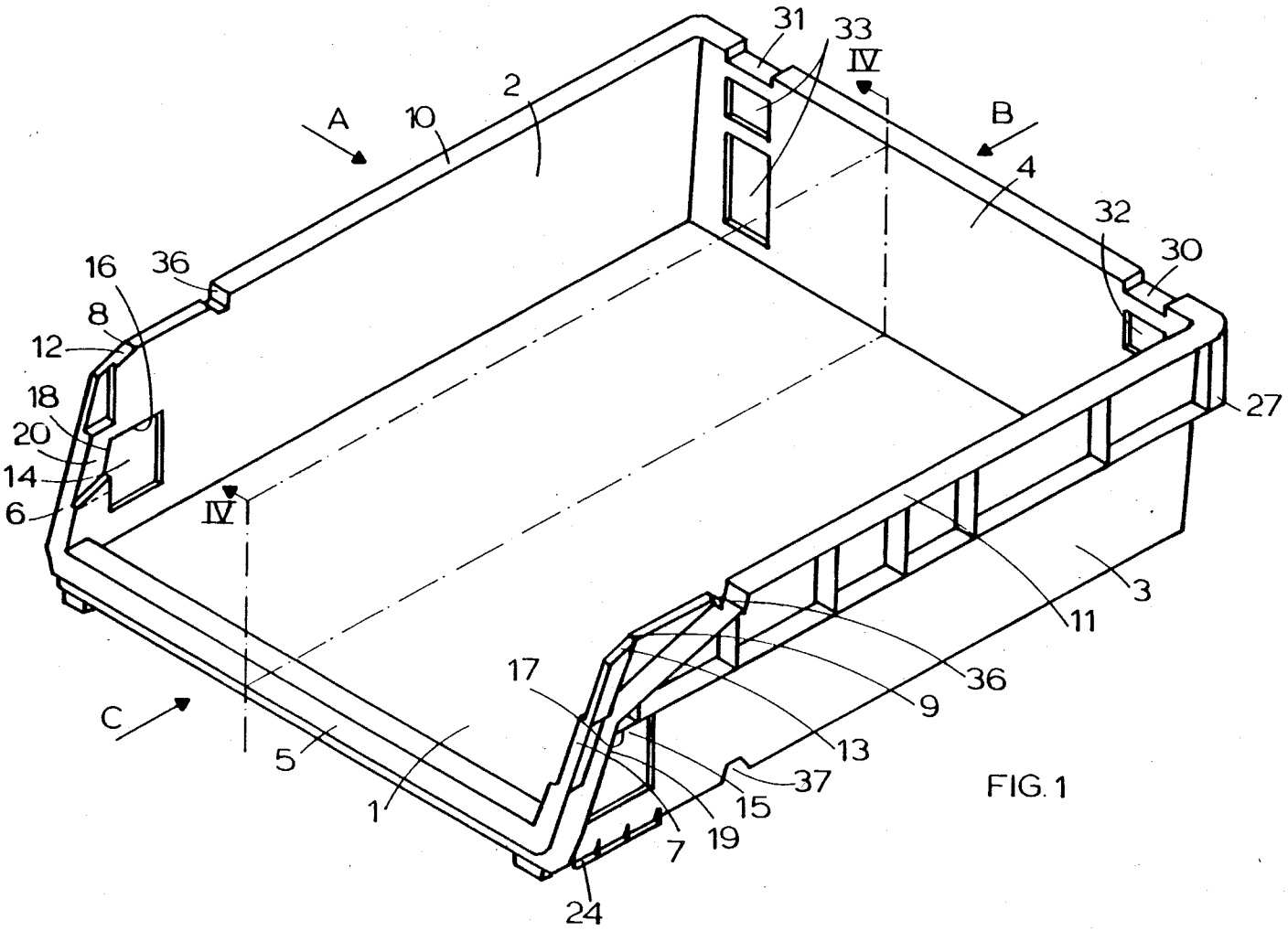
FIG. 1 is a perspective view of a box according to the invention.

The perspective view in FIG. 1 shows a box according to the invention with a rectangular bottom 1, two side walls 2 and 3, a back wall 4 and a lowered front wall 5. The walls 2, 3 and 4 diverge, starting at the bottom.

The fronts 6 and 7 of the side walls 2 and 3 have been bevelled off and pass into the tops 10 and 11 of the side walls 2 and 3 via the vertices 8 and 9, making obtuse angles. In the embodiment as drawn, the fronts have in part been bevelled off slightly more steeply, so that between the fronts 6 and 7 and the respective tops 10 and 11 of the side walls 2 and 3 short planes 12 and 13 are present. Near the fronts 6 and 7, openings 14 and 15 have been provided in the side walls 2 and 3, with topmost bounding planes 16 and 17 located at substantially one third of the side wall height from the tops 10 and 11 and with vertical front-most bounding planes 18 and 19 which are totally before the perpendiculars h projected from the vertices 8 and 9 upon the bottom, as indicated for side wall 2 in FIG. 4.

Since the two side walls 2 and 3 are mirror images of each other, for the sake of simplicity and clarity the following section of the figure description refers to side wall 2 only.

Figure 2:
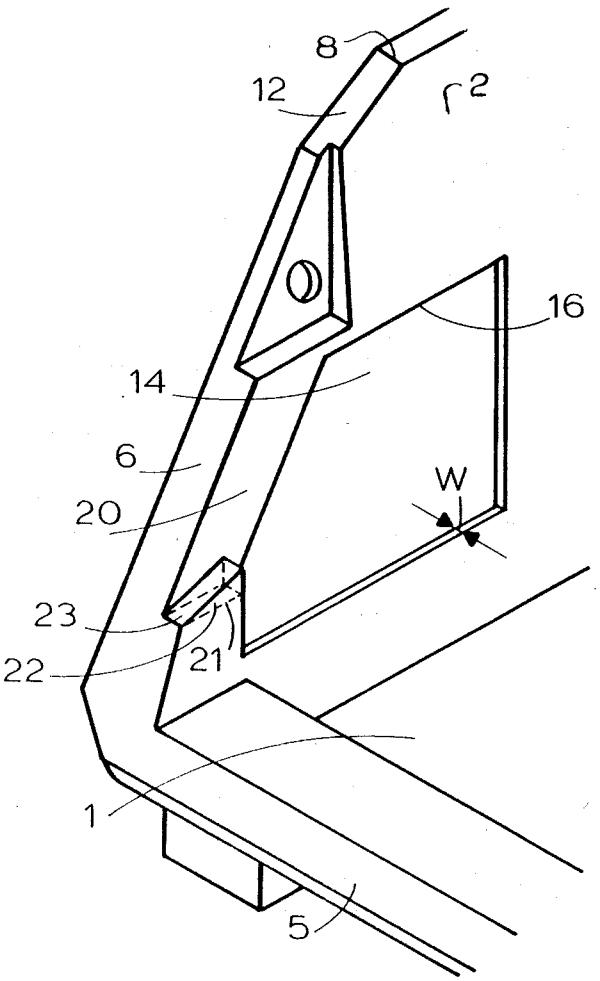
FIG. 2 is a perspective view of the front of side wall 2 of the box according to FIG. 1, on a larger scale.

Wall section 20 of side wall 2, between the opening 14 and the front 6 of the side wall, gradually goes outward as it goes downward, to a distance of twice a horizontal wall thickness w, forming a ridge 21 having a width of twice the horizontal wall thickness, while on the ridge an inside protrusion 22 has been provided which has a top plane 23 going upward in the direction of the back wall 4. In FIG. 2, this structure has been drawn on a larger scale for clarify of presentation. On the outside of the side wall 2, as visible in FIGS. 3, 5 and 6, below the opening 14 an outside protrusion 24 is present whose underside 26 coincides with the underside 25 of the side wall 2. The distance between the underside of the inside protrusion 22, which is ridge 21, and the underside 26 of outside protrusion 24 is in this case one third of the side wall height z.

The outside protrusions 24 extend laterally not further than the side wall thickness plus the nesting clearance, the latter usually being ca. 1 mm.

The box has outwardly directed rim sections indicated by the number 27 in the drawing. These rim sections have a height s as indicated in FIG. 4 which is substantially one third of the side wall height z.

The lowered front wall 5 designed as a threshold has an inside height which does not exceed the inside distance between the ridge 21 and the bottom 1. See FIG. 2.

Figure 3:
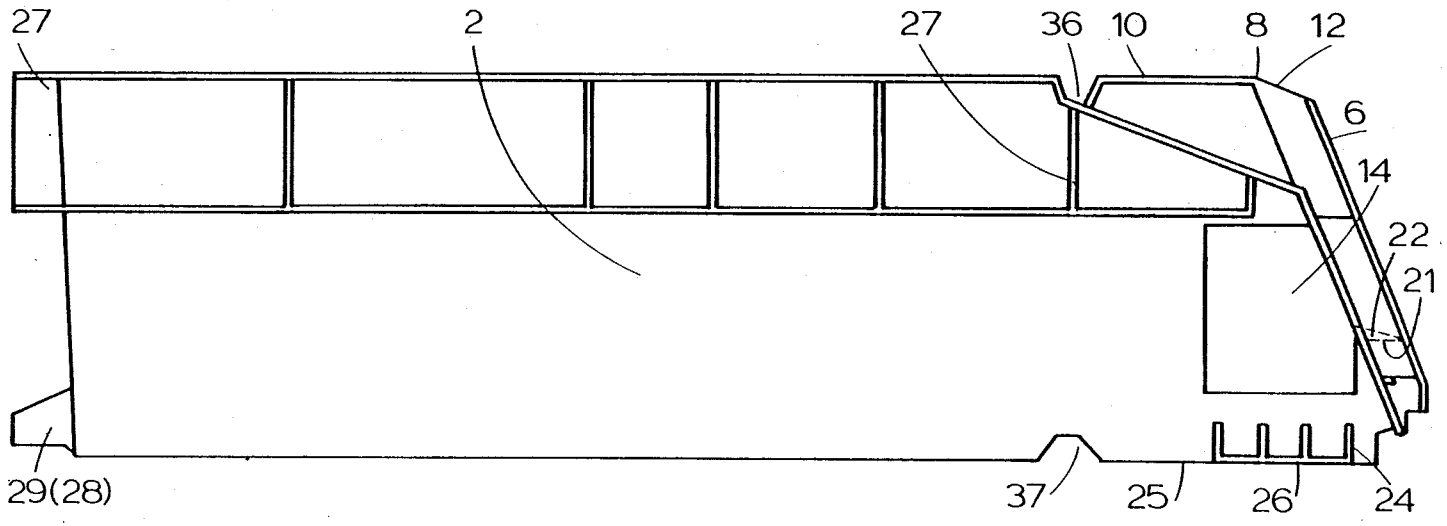
FIG. 3 is a side view of the box according to arrow A in FIG. 1.
Figure 5:
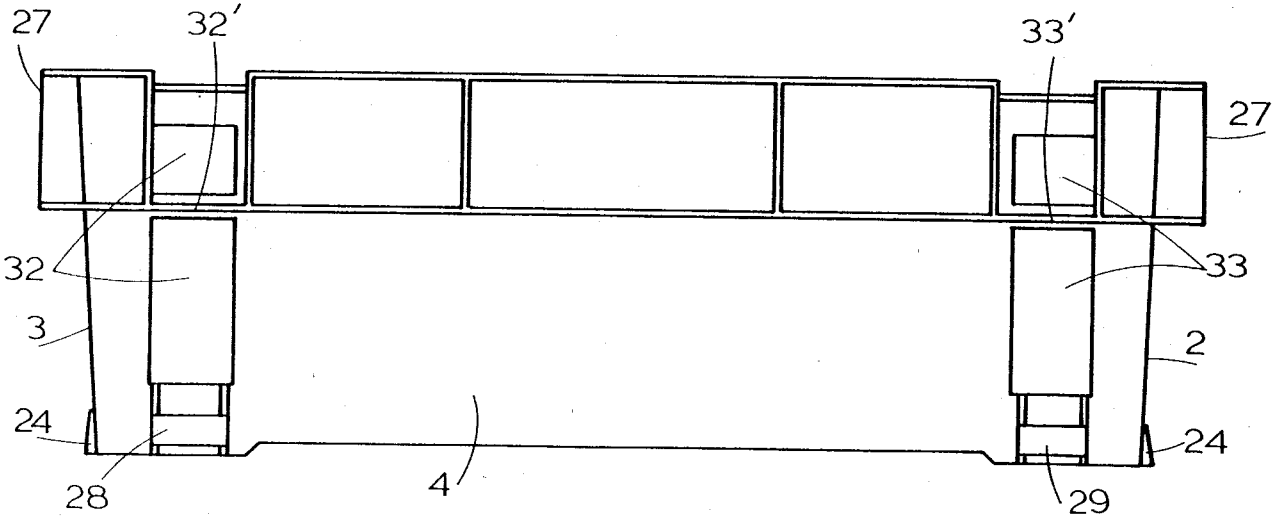
FIG. 5 is a front view of the box according to arrow B in FIG. 1.
Figure 6:
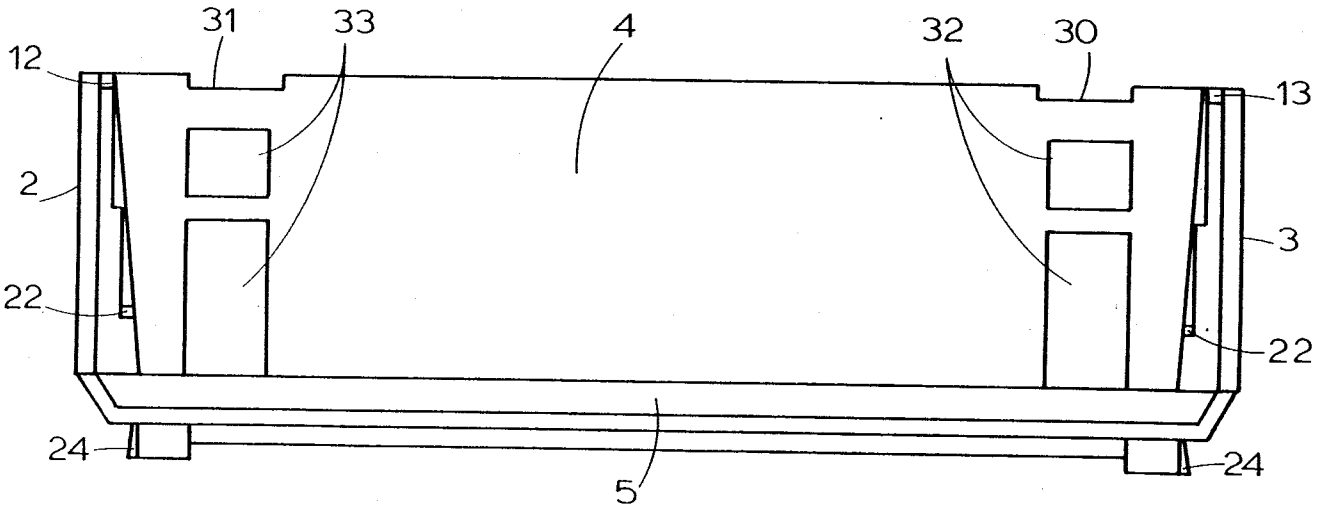
FIG. 6 is a front view of the box according to arrow C in FIG. 1.

The back of the box is according to FIGS. 3 and 5 provided with stacking protrusions 28 and 29 which, when boxes are stacked, fit in recesses 30 and 31 in the back wall of a next-lower box. The back wall is further provided with openings 32 and 33 through which the protrusions can project when boxes are nested. The openings 32 and 33 are each interrupted by a back wall section, 32' and 33' respectively.

Figure 4:
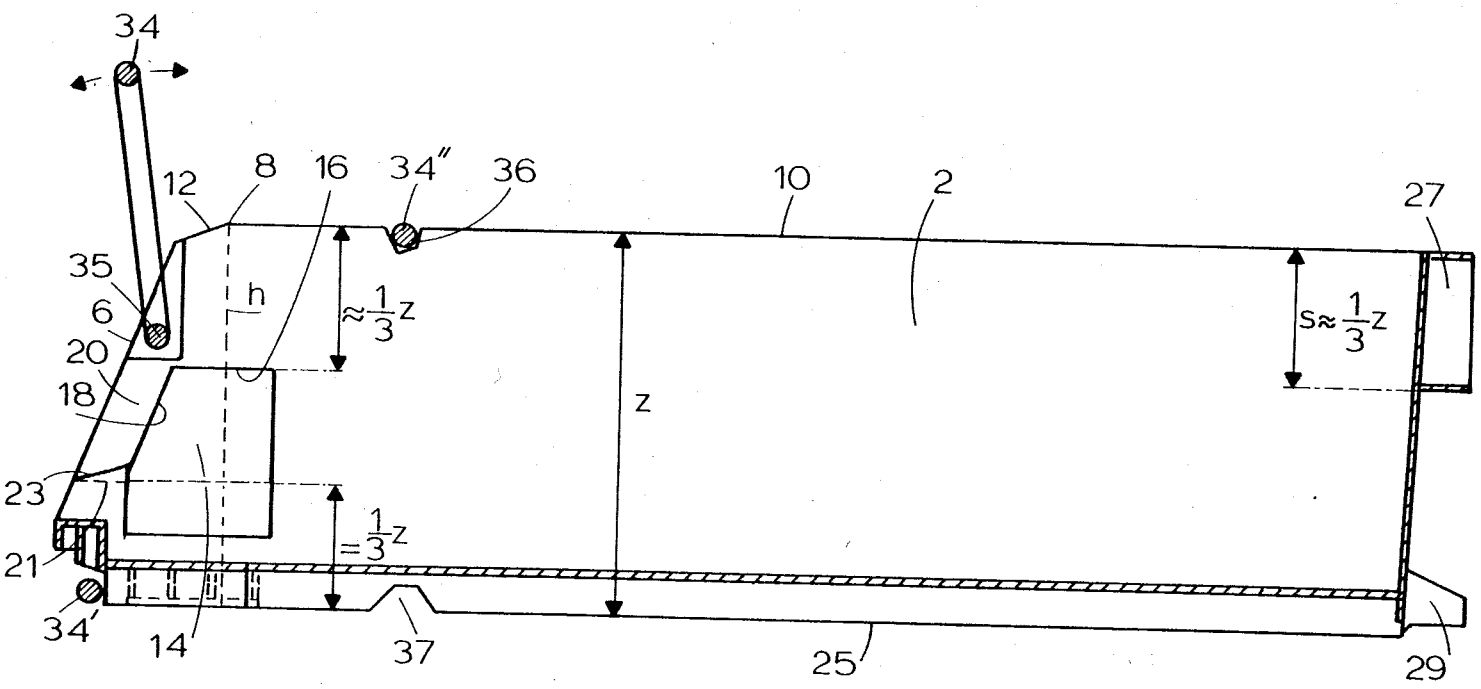
FIG. 4 is a sectional view, the section being along line IV—IV in FIG. 1.

In FIG. 4 a fold-away stacking support 34 is schematically indicated which by pivoting around pivot 35 can be brought from a lower position 34' into an upper position 34'' were it will lie in recesses 36 in the tops of the side walls. Perpendicularly below the recesses 36 are recesses 37 at the underside of the side walls. When a box is stacked on top of another one, with the support 34 of the latter being in the position 34'', the top box rests with the recesses 37 on the support 34 of the lower box. The stacking and nesting of the boxes are as follows. By stacking, the back of a box rests with its stacking protrusions 28 and 29 in recesses 30 and 31 of a next-lower box while the front of the box rests on the support 34. For nesting, the box can be placed in a next-lower box in such a way that it projects forward to some extent, the outwardly directed rims of the upper box resting on those of the lower box. When the upper box is now moved backwards, the outside protrusions 24 move upwards along the inside protrusions 22. When the box is moved backwards further, the outside protrusions 24 finally fall behind the inside protrusions 22, establishing a lock. With a different way of nesting, which is also a possibility offered by the box according to the invention, the stacking supports 28 and 29 are first moved through openings 33 and 32 at an angle, after which the front of the box can more or less be vertically lowered to its locked position, without the outside protrusions being obstructed by wall sections above the openings of a lower box during the vertical motion.

I claim:

1. Nestable and stackable box comprising a rectangular bottom, two side walls and a back wall each of which upwardly and outwardly diverge relative to one another, a lowered front wall and a fold-away stacking support, each of said side walls including front and top edges, the front edge of each side wall being bevelled to form an obtuse angle with the top edge thereof, each said side wall defining an opening near said front edge such that a vertical plane bounding the opening at the front edge is located forwardly of a perpendicular line projecting from a vertex of the obtuse angle formed between the front and the top edges of the side wall, at least a portion of an interior surface of said side wall between the opening and the front edge extending outwardly and downwardly to a distance of one to three times its horizontal wall thickness to thereby form a ridge having a width of one to three times the horizontal wall thickness, and an inside protrusion provided on said ridge and disposed adjacent said interior surface of said side wall, an outside protrusion projecting from an exterior of the side wall and located below the opening, the outside protrusion defining an underside positioned at a distance of at least one third of the side wall height beneath the ridge wherein the outside protrusion extends laterally not further than the side wall thickness plus a predetermined nesting clearance, said inside and outside protrusions together establishing locking means to lock a pair of said boxes in nested relationship with one another by virtue of said outside protrusion of one box being positioned rearwardly of and adjacently to said inside protrusion of another box when said pair of boxes are in said nested relationship.

2. Box according to claim 1, further including outwardly directed upper rim sections the height of which is substantially one third of the side wall height.

3. Box according to claim 1, wherein an upper portion of the plane bounding the opening is located at substantially one third of the side wall height from the top edge of the side wall.

4. Box according to claim 1, wherein the inside protrusion defines a top plane sloping upwardly in the direction of the back wall.

5. Box according to claim 1, wherein the box an inside height of the front wall from the bottom does not exceed the distance between the bottom and the ridge.

6. Box according to claim 1, the back wall includes a pair backward-projecting stacking protrusions and a pair of apertures positioned above the protrusions near the top of the box, said stacking protrusions of said one box projecting into respective said apertures of said other box when said pair of boxes is in said nested relationship.

7. A nestable and stackable box comprising:

a bottom wall;

a pair of opposing, spaced-apart side walls joined to and vertically extending from said bottom wall;

a rear wall joined to said bottom wall and to each said side wall, said bottom wall, side walls and rear wall defining respective interior surfaces which together establish an interior space, each said interior surface of said side walls and rear wall being upwardly and outwardly divergent relative to one another, said side walls and rear wall also together defining an upper edge vertically spaced above said bottom wall by a predetermined dimension;

support means for permitting the vertical stacking of a pair of said boxes, said support means being pivotally connected to a forward portion of each said side wall and including a support bar spanning said spaced-apart side walls, said support means being pivotal between a nonsupporting position wherein nesting of one box within another box of said pair of boxes is permitted, and a supporting position wherein said support bar supports said one box in a vertically-stacked relationship to said another box of said pair of boxes;

each said side wall including locking means to removably lock said one and another boxes in a nested relationship, said locking means including:

(a) means defining a bevelled forward edge intersecting said top edge to establish an obtuse angle therewith;

(b) opening means defining a lateral opening disposed below said intersection of said forward and top edges;

(c) outer projecting means projecting laterally of said side wall, said outer projecting means being disposed below said defined lateral opening; and (d) inner projecting means projecting into said established interior space from said interior surface of said side wall, said outer projecting means of said one box being positioned rearwardly of and adjacently to said inner projecting means of said another box when said one box is nested with said another box to thereby removably lock said pair boxes in said nested relationship, and said opening means for permitting said one box of said pair of said boxes to be vertically moved into said nested relationship with said another box by permitting said outer projecting means of said one box to project thereinto during said vertical movement until said outer projecting means thereof is positioned rearwardly of said inner projecting means of said another box thereby locking said one and other boxes in said nested relationship.

* * * * *